US008668054B2

(12) United States Patent
Silberhorn

(10) Patent No.: US 8,668,054 B2
(45) Date of Patent: Mar. 11, 2014

(54) COUNTERWEIGHT IN AN ELEVATOR INSTALLATION

(75) Inventor: Gert Silberhorn, Merlischachen (CH)

(73) Assignee: Inventio AG, Hergiswil (CH)

( * ) Notice: Subject to any disclaimer, the term of this patent is extended or adjusted under 35 U.S.C. 154(b) by 288 days.

(21) Appl. No.: 13/142,348

(22) PCT Filed: Dec. 18, 2009

(86) PCT No.: PCT/EP2009/067473

§ 371 (c)(1),
(2), (4) Date: Jun. 27, 2011

(87) PCT Pub. No.: WO2010/072657

PCT Pub. Date: Jul. 1, 2010

(65) Prior Publication Data

US 2011/0266095 A1 Nov. 3, 2011

(30) Foreign Application Priority Data

Dec. 26, 2008 (EP) ..... 08172948

(51) Int. Cl.
*B66B 17/12* (2006.01)

(52) U.S. Cl.
USPC ..... 187/249

(58) Field of Classification Search
CPC ..... B66B 17/12; B66B 7/06
USPC ..... 187/404–405
See application file for complete search history.

(56) References Cited

U.S. PATENT DOCUMENTS

| | | | | |
|---|---|---|---|---|
| 696,706 | A | 4/1902 | Baldwin | |
| 807,794 | A * | 12/1905 | Venn | 187/405 |
| 3,738,455 | A * | 6/1973 | Tintore | 187/405 |
| 3,845,842 | A * | 11/1974 | Johnson | 187/266 |
| 2009/0301818 | A1 * | 12/2009 | Hashiguchi | 187/249 |

FOREIGN PATENT DOCUMENTS

| | | | |
|---|---|---|---|
| CN | 1709783 | A | 12/2005 |
| EP | 1489033 | A1 | 12/2004 |
| WO | 2006035257 | A1 | 4/2006 |
| WO | 2006082460 | A1 | 8/2006 |

OTHER PUBLICATIONS

Machine Translation of CN1709783 A.*

* cited by examiner

*Primary Examiner* — William E Dondero
*Assistant Examiner* — Diem Tran
(74) *Attorney, Agent, or Firm* — Fraser Clemens Martin & Miller, LLC; William J. Clemens

(57) ABSTRACT

An elevator installation includes at least one elevator car and at least one counterweight, wherein the at least one elevator car is capable of being moved on guide rails in an elevator shaft by a drive with a driving pulley and with a supporting and propulsion apparatus. The at least one counterweight is formed with a hollow body enclosing a filling. In the event of a freefall, the hollow body is destroyed allowing the filling to emerge.

15 Claims, 6 Drawing Sheets

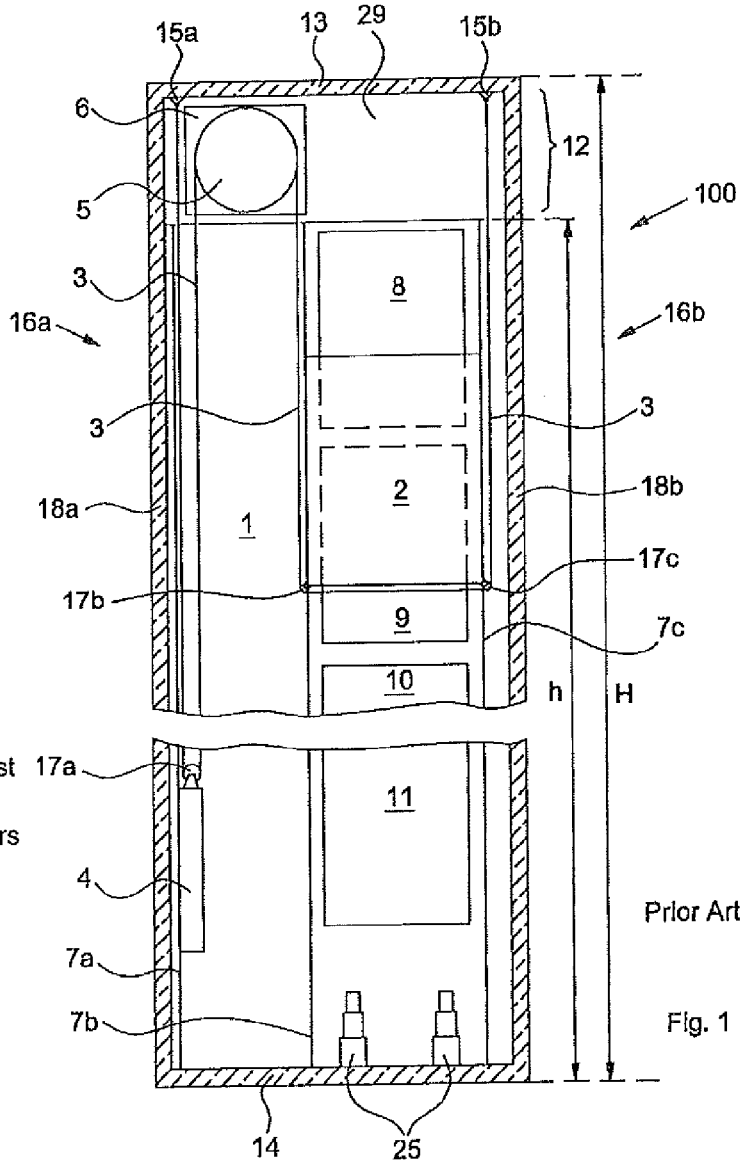

100 elevator installation
1 elevator shaft
2 elevator car
3 supporting and driving means
4 counterweight
5 drive pulley
6 drive unit
7a-7c guide rail
8 uppermost floor door
9 second-uppermost floor door
10 further floor doors
11 lowermost floor door
12 shaft head
13 shaft ceiling
14 shaft base
15a first fastening point
15b second fixing point
16a support loop
16b second support loop
17a-17c support roller
18a-18b shaft wall
25 buffer
29 space
H total height
h operating height Prior Art

Fig. 1

100a duo-mobile elevator installation
1a elevator shaft
2a upper elevator car
2b lower elevator car
3a-3b supporting and driving means
4a-4b counterweight
5a-5b drive pulley
6a-6b drive unit
7d-7f guide rail
8a uppermost floor door
9a second-uppermost floor door
10a-10f floor door
11a floor door
12 shaft head
13a shaft ceiling
14a shaft base
15c-15d fastening point
16c-16d support loop
17d-17g support roller
18c-18d side wall
21a-21b abutment
25a buffer
35 shaft pit
H overall height
$h_1$-$h_2$ shaft height

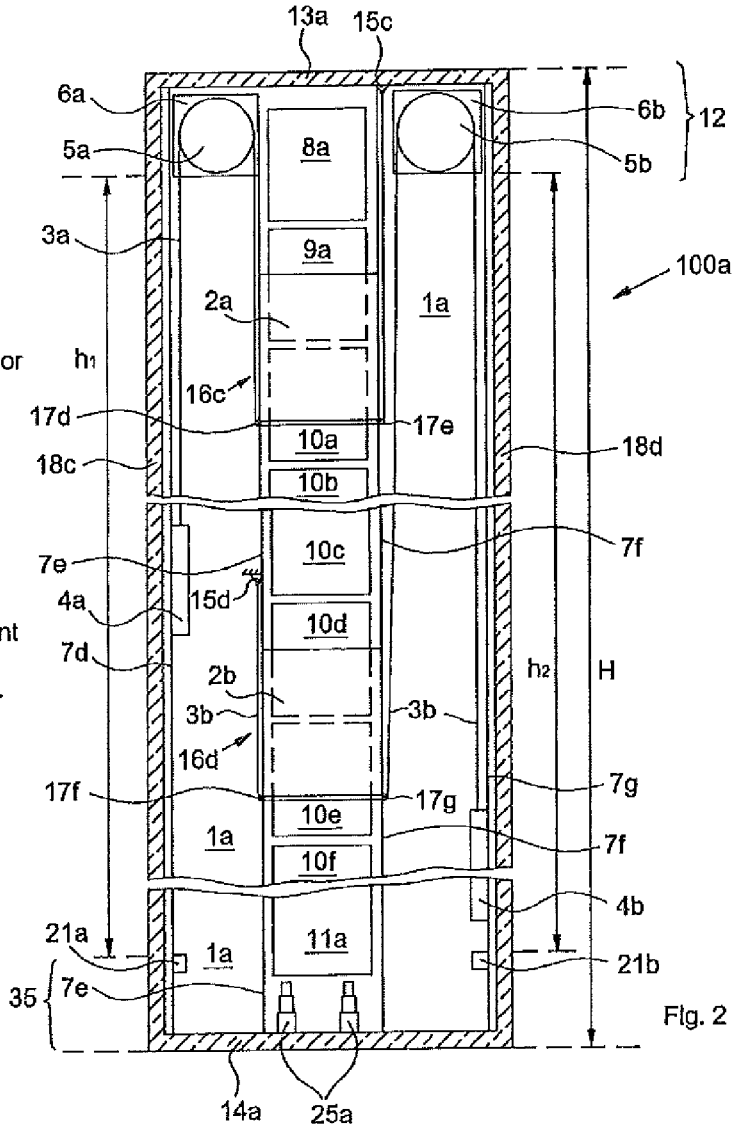

Fig. 2

3 supporting and driving means
4c counterweight
7d guide rail
18c shaft wall
19a-19b guide element
20 filling
21a abutment
23 cavity
34 hollow body 3 supporting and driving means
4c counterweight
7d guide rail
18c shaft wall
19a-19b guide element
20 filling
21a abutment
22 explosive charge
23 cavity
34 hollow body

COUNTERWEIGHT IN AN ELEVATOR INSTALLATION

FIELD OF THE INVENTION

The present invention relates to an elevator installation in which an elevator car and a counterweight, guided by way of rollers, are motor-driven in an elevator shaft, wherein the counterweight is formed as a hollow body.

BACKGROUND OF THE INVENTION

There are elevator installations, so-termed 'multi-mobile elevators', such as disclosed in, for example, EP-A1-1 489 033, with elevator car arranged one above the other in a shaft. Elevator installations comprise at least two elevator cars arranged one above the other and movable vertically on guide rails, wherein each is equipped with a separate drive and a separate counterweight. The floors to be served are in this regard preferably distributed in such a manner that an upper elevator car travels to the upper floors and a lower elevator car travels to the lower floors. However, intersections of this allocation are also realized.

At the same time, however, it is in general endeavored to achieve a high level of efficiency or rate of passenger and/or goods transport in the concept or construction of elevator installations. A significant factor in that respect is optimum utilization of the cross-section of the elevator shaft.

This in turn is effected, inter alia, by a counterweight design which is as slender and space-saving as possible, so that the elevator car can be of the largest area possible in the cross-section thereof.

In the case of a duo-mobile or multi-mobile elevator installation such as is known from the state of the art an optimization of the size of the counterweight is even more stringent, because the elevator shafts of such elevator installations by contrast to conventional elevator installations with only one elevator car have to accommodate not just one counterweight, but two or more counterweights.

SUMMARY OF THE INVENTION

An object of the present invention is to eliminate the stated disadvantages of elevator installations according to the prior art and to find counterweights which are optimized not only with respect to the dimensions thereof, but also with respect to the weight thereof and other characteristics.

Fulfillment of the set object consists on the one hand in a conceptual arrangement and design of the elevator installation and on the other hand in an adaptation of the drive system. The thereby-achieved volume and weight reduction of the counterweight or counterweights makes possible a new and optimized construction of the counterweight body and the guidance thereof.

An optimization of the counterweights results from the combination of these measures, which, inter alia, also makes possible an improved utilization of the shaft cross-section, in particular also with respect to the weight and volume reduction of the counterweight.

An exemplifying embodiment of a counterweight can be realized not only in an elevator installation which has only one counterweight, but also in elevator installations which have several counterweights.

There is set as a concrete objective for optimization of the counterweights in the elevator installation, particularly in the case of duo-mobile or multi-mobile elevator installations in which two or more than two elevator cars are arranged one above the another, are the finding of an improved safety system for a freefall, which is in principle possible, of the counterweights.

In correspondence with international safety regulations an elevator installation must provide, in particular, a mechanical system which for the case of supporting and driving means breakage prevents unbraked impact of the counterweights on the shaft base. Particularly in multiple elevator installations a freely falling counterweight could cause substantial damage in that it damages not only the shaft base or the shaft and the guide rails, but also elevator cars which are located thereunder and which in certain circumstances persons may even be present.

An exemplifying embodiment of a counterweight is constructed as a hollow body which is filled with a material or substance with a high mass density. Coming into consideration as filling is or are, for example, sand or metal power or metal scrap or liquids such as, for example, water. The relative density d of the material of the filling is preferably at least 1.

In one form of embodiment this hollow body is made from a one-piece body. Such a hollow body is distinguished by particularly easy handling during assembly. Thus, the hollow body does not need to be constructed in numerous working steps from several parts, but can be directly positioned in the elevator shaft in a desired position.

Moreover, the hollow bodies are preferably made of synthetic material. Furthermore, the hollow body is preferably an extruded synthetic material body with already integrated guide elements and fastening points.

According to a preferred variant of embodiment a counterweight or the synthetic material body is so designed in terms of function that in the case of a 'freefall' it is divided or destroyed and thereby its content released in finely distributed form into the elevator shaft.

According to the invention the following advantages are thereby achieved:

A dissipation, without harm, takes place of the kinetic energy which the counterweight develops by its freefall.

The counterweight loses its destructive energy of the impact, so that a more expensive and more complicated mechanical safety system can be replaced.

Particularly for multiple elevator installations, for example with several duo-mobiles in one elevator shaft, the equipment with the counterweights described here represents a significant constructional simplification.

The safety of the other elevator cars in the elevator shaft is guaranteed.

The dividing or destruction of the counterweight takes place, in accordance with a variant of embodiment according to the invention, by an abutment which is arranged, for example, at the guide rails of the counterweight below the normal operating height of the counterweight at an end of a travel path of the counterweight.

The higher this abutment is mounted away from the shaft base the earlier and more effectively can the dissipation of the kinetic energy of a freely falling counterweight thus take place. However, the arrangement of the abutment close to or at the shaft base still brings advantages, because a body which is destroyed shortly before or at the time of impact can no longer develop the same impact energy as a solid or still intact body.

According to a further variant of embodiment a fixedly positioned knife is provided which slits the counterweight body.

In another—or, however, also combinable—variant of embodiment an explosive charge or an explosive belt formed from several small explosive charges is arranged at the counterweight. Triggering of ignition of the explosive charge can in principle be carried out by electrical or optoelectrical sensors, but simple mechanical triggers which function reliably even in the case of power failure are preferred. A simple mechanical trigger of that kind for the ignition can be, for example, a trigger lever fastened to the guide rail or a ripcord of appropriate length fastened to the shaft ceiling.

A further variant of embodiment of a counterweight makes use of the fact that the physical magnitude which is most readily capable of being measured and which arises in the case of breakage of the supporting and driving means is the tensile stress in the supporting and driving means or at the fastening of the supporting and driving means to the counterweight. A sensor-based detection of this tensile stress in turn gives a reliable trigger value which advantageously is already available very early, namely even on the path length of the counterweight within the normal operating height or immediately at the beginning of the freefall of the counterweight.

This trigger value can in turn be used for the ignition of the previously described explosive charges or, however, also for, for example, ignition of a pyrotechnical capsule or actuation of a piezoelectric actuator and thereby triggering of a gas bag similar to an airbag. The expansion, similar to an explosion, of the gas bag within the hollow body, which is preferably filled in this case with a liquid, has the effect that a pressure is exerted from inside against the side walls. The side walls are preferably provided with frangible seams which withstand the pressure of the filling material, but not the increased internal pressure through the gas bag. The hollow body thereby opens even during the start of the freefall and distributes its content quite early and over a longer path.

The mere opening of the hollow body already disposed in freefall still does not have the consequence of issue of the liquid, since the physical system, as considered in itself, of counterweight inclusive of the liquid it contains is disposed in freefall. The stored pressure of the gas bag is, however, independent thereof and, when it develops, expels the content from the hollow body of the counterweight.

An optimization of the opening of the side walls can optionally be achieved in that the side walls are provided at the underside thereof with the frangible seam and at the upper side thereof with a hinge or a further seam. This second seam or notch at the upper side of the side walls is designed so that the triggering of the gas bag does not allow it to burst. However, it represents a weakened-material edge at which the side wall can open as at a hinge.

The described variants of embodiment can be combined with one another, thus, for example, a mechanical triggering of the gas bag can also be realized or an ignition of the explosive charge by way of a signal originating from the sensor which indicates loss of the tensile stress between supporting and driving means and counterweight.

With respect to the last-mentioned sensor it is also possible to realize a purely mechanical solution in that a tension spring of appropriate strength is arranged between the supporting and driving means and the counterweight. The springing back of the tension spring in case of loss of the tensile stress between supporting and driving means and counterweight can be realized—again also purely mechanically—as a trigger for ignition of the explosive charge or as a trigger for the 'explosion' of the gas bag.

As already mentioned in the introduction, the embodiments disclosed herein of counterweights are suitable not only for individual elevator installations, but also for multiple elevator installations. The counterweight embodiments illustrated here are advantageous particularly in the case of the latter and especially in multiple elevator installations. This is on the one hand for the reason that in the case of this form of embodiment of an elevator installation elevator cars can be arranged under the counterweight. On the other hand, an elevator installation with two elevator cars, which are suspended in the suspension ratio of 2:1 in combination with a respective counterweight suspended in the suspension ratio 1:1, particularly makes possible the use of the relatively light counterweight embodiments described herein.

An exemplifying embodiment of a just mentioned elevator installation has at least two elevator cars which are arranged one above the other and which are each connected by way of supporting and driving means with a respective counterweight. In addition, the elevator installation has at least two drives which each drive a respective drive pulley in operative contact with a respective supporting and driving means so that the elevator cars are movable along guide rails in an elevator shaft. The elevator cars are, as already mentioned, suspended in a 2:1 suspension in a support loop of the respective supporting and driving means. Thereagainst, the counterweights are suspended in a 1:1 suspension at each end of the supporting and driving means.

In particular, a supporting and driving means runs around the drive pulley and is preferably fixedly fastened by a first end to the ceiling or in the region of the ceiling of the elevator shaft. The drive or the drive pulley is preferably equally arranged at the ceiling or in the region of the ceiling of the elevator shaft at a spacing from the fixing point of the first end so that the supporting and driving means forms a support loop. This support loop supports the first, upper elevator car preferably by means of two rollers which are arranged at lower edges of the elevator car. A second end of the supporting and driving means is fastened to a first counterweight.

In particular, the second elevator car arranged below the first is supported in a support loop of a second, separately guided supporting and driving means. This second supporting and driving means is fastened by a first end or a first end of the support loop preferably also to the ceiling or in the region of the ceiling of the elevator shaft. The second elevator car is also preferably suspended in the support loop by means of two rollers arranged at two lower edges of the elevator car, wherein the second end of the support loop is led to a second drive or to a second drive pulley which is preferably equally disposed at the ceiling or in the region of the ceiling of the elevator shaft. A second end of the second supporting and driving means is again fastened to a second counterweight.

According to this exemplifying embodiment the elevator cars considered in themselves are disposed in a so-called 2:1 suspension, whereas the counterweights considered by themselves are disposed in a so-called 1:1 suspension.

In this way it is achieved that the counterweights can travel over almost the entire shaft height. By virtue of the 2:1 suspension of the elevator cars by comparison with the 1:1 suspension of the counterweights, the counterweights cover a working travel which is twice as long as the elevator cars and thus also only have to be designed to be half as heavy or bulky. In turn, the shaft cross-section is thus occupied to a smaller extent by the counterweights and the elevator car plan area can be increased, the shaft cross-section can be reduced or the counterweight can, according to one of the above-described exemplifying embodiments, be constructed as a hollow body filled with a material or substance with high mass density.

The elevator installation is, as a simultaneous measure, equipped with a supporting and driving means which allows a significantly higher level of traction than conventional steel cable traction systems. By traction system there is understood here the traction forces transmitted between a drive pulley and a supporting and driving means by way of friction couple.

The traction system has a drive capability with a factor (system coefficient of friction) in a range of 1.5 to 2.5, but preferably at least 2. This means that the traction forces are high enough to move an elevator car which is heavier by the system coefficient of friction than the associated counterweight.

It is thereby possible to provide the required force relationships for the traction even with a counterweight which is lighter and possibly also of smaller size.

The thus-achieved reduction in the weight of the counterweights makes it possible to design the counterweights according to, for example, one of the above exemplifying embodiments.

A further advantage is a facilitated installation and mounting of the counterweights. The guides and possible deflecting rollers also no longer have to be designed to be so robust, so that costs and weight can be saved not only with respect to the counterweights themselves, but also with respect to the guides thereof. In the case of appropriate design of the assembly processes the counterweights can be fitted in complete and preassembled state in the elevator shaft by a crane. The lower weight then allows a correspondingly simple installation process in the counterweight guide system.

The potential of the elevator installation can additionally be optimized in an exemplifying embodiment by the use of appropriate lightweight cars.

In a building in which several duo-mobile systems are arranged in a shaft one above the other, it is possible through appropriate positioning of the upper deflecting rollers or the drive pulley to also realize correspondingly large or small overlaps of the end or edge zones, i.e. so that a defined number of floors is also served by the adjacent elevator cars and a defined number of floors is also served even by the adjacent elevator cars of the adjacent elevator cars.

In order to save further costs, it is also possible in an exemplifying embodiment for common travel paths to be designed for the counterweights. In this case, similar safety steps as for the cars have to be provided so as to exclude collisions and dangerous states. In addition, a superordinate (destination call) control would have to take this into consideration in advance for the processing of the destination journeys.

A further improved utilization of the shaft cross-section can be achieved in accordance with an exemplifying embodiment in that the support rollers project at the undersides of the elevator cars beyond the body of the elevator car. A shaft utilization is thereby possible which provides guidance of the counterweights at two (not necessarily opposite) walls.

A third wall of the elevator shaft is in this exemplifying embodiment provided for guidance of the elevator car. It is open to select the wall with the floor doors for this third wall. The guidance of the supporting and driving means along a fourth shaft wall is not—due to the protruding support rollers—provided vertically, i.e. parallel to the shaft walls and car walls, but diagonally or obliquely. This in turn means that the supporting and driving means, the rollers provided therefor and the drive pulleys only have to be arranged on one side outside a notional projection area of the car cross-section. In this manner it is achieved that the cross-section of the elevator shaft is even better utilized in that only one (instead of two) of four sides is provided for guidance of the supporting and driving means.

Also lying within the scope of other exemplifying embodiments are elevator installation arrangements or suspensions which similarly provide a 1:1 suspension for the counterweights, whereagainst not only a 2:1, but also a 3:1 or 4:1 suspension for the elevator cars. This is possible, for example, in that the support loop formed by the supporting and driving means runs not directly from the drive pulley, but runs around two deflecting rollers. The first deflecting roller is in this regard preferably so arranged that the drive pulley is, for building up the necessary adhesive friction, disposed in contact with the supporting and driving means on a circular segment which is larger than merely 90 degrees (preferably more than 180 degrees).

In this manner a suspension arrangement can be realized which is constructed in accordance with the basic principle of a factor block-and-tackle. However, a suspension arrangement is also possible which is constructed in accordance with the basic principle of a power block-and-tackle, i.e. the free end of the support loop for the elevator car hangs at the axis of a free roller.

The subject of the invention is also a method for dissipation of the kinetic energy of a counterweight in an elevator installation. This method comprises the following steps:

monitoring the counterweight;

occurrence of an impermissible operational state; and taking a measure for destroying the hollow body of the counterweight.

The monitoring of the counterweight includes not only monitoring of the tensile stress of the supporting and driving means at which the counterweight is suspended, but also the position of the counterweight in relation to an associated travel path end. In the former case the sensors described in the introduction are used. In the latter case use is preferably made of mechanical systems.

An impermissible operational state occurs when either the tensile stress of the supporting and driving means is lost or the counterweight has passed a lowermost permissible position on its travel path.

After occurrence of this impermissible operational state the hollow body is destroyed by one of the previously mentioned measures.

DESCRIPTION OF THE DRAWINGS

The invention is explained in more detail symbolically and by way of example on the basis of figures. The figures are described conjunctively and in general. The same reference numerals signify the same components and reference numerals with different indices indicate functionally equivalent or similar components. In that case:

FIG. 1 shows a schematic illustration of an elevator installation according to the prior art;

FIG. 2 shows a schematic illustration of a duo-mobile elevator installation;

DETAILED DESCRIPTION OF THE INVENTION

Figure 3:
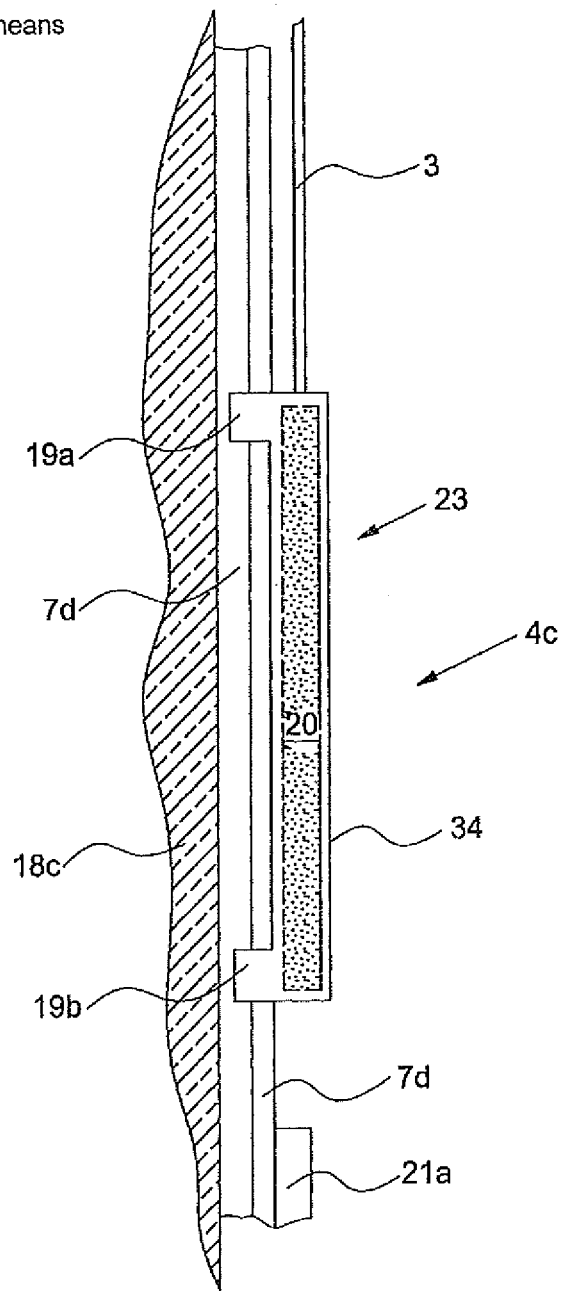
FIG. 3 shows a schematic illustration of a counterweight according to the invention.

FIG. 1 schematically shows an elevator installation 100 such as corresponds with the prior art. It has an elevator car 2 which is movable in an elevator shaft 1 and which is connected with a counterweight 4 by way of a supporting and driving means 3. The supporting and driving means 3 is, in operation, driven by a drive pulley 5 of a drive unit 6. The elevator car 2 and counterweight 4 are guided by means of guide rails 7*a*-7*c* extending over the shaft height.

The elevator installation 100 has an uppermost floor with an uppermost floor door 8, a second-uppermost floor with a second-uppermost floor door 9, further floors with further floor doors 10 and a lowermost floor with a lowermost floor door 11. A shaft head 12 conceals a space 29 in which the drive unit 6 is arranged. By "shaft head" 12 there is to be understood a region of the elevator shaft 1 which extends between a shaft ceiling 13 and an elevator car 2 stopped at the uppermost floor.

The elevator shaft 1 has lateral shaft walls 18*a* and 18*b* and a shaft base 14 on which the buffer 25 is arranged. The shaft base 14 and a shaft ceiling 13 define a total height H of the elevator shaft 1. The total height H less the height of the shaft head 12 gives an operating height h in which the elevator car 2 and the counterweight 4 are movable.

In an elevator installation 100 corresponding with the illustrated form of the prior art the supporting and driving means 3 form from a first fastening point 15*a* at the shaft ceiling 13 to the drive pulley 5 a support loop 16*a* in which the counterweight 4 runs by means of a support roller 17*a*. This form of suspension of the counterweight represents a 2:1 suspension.

The supporting and driving means 3 further defines a second support loop 16*b*, in which the elevator car 2 is supported by means of support rollers 17*b* and 17*c*, from the drive pulley 5 to a second fixing point 15*b* at the shaft ceiling 13. This suspension also represents a 2:1 suspension for the elevator car 2.

The 2:1 suspension—not only for the counterweight 4, but also for the elevator car 2—means that the travel of the counterweight 4 corresponds with the travel of the elevator car 2 and basically the weight (physically correctly, the mass) of the counterweight 4 must correspond with the mass of the elevator car 2 under normal occupancy. In the case of a usual car size normal occupancy means two to three persons, which equals a mass of approximately 180 kg. This means that the counterweight has to have a mass which corresponds with the mass of the empty elevator car plus approximately 180 kg. Departures therefrom are borne by a system coefficient of friction or the drive. The system coefficient of friction is dependent on the traction capability of a traction system. By "traction system" there is to be understood here the traction forces transmitted between a drive pulley and a supporting and driving means by way of friction couple. If the traction system has a drive capability with a system coefficient of friction of, for example, 2, this means that the traction forces are sufficiently high in order to move the elevator car, which is heavier by the system coefficient of friction than the associated counterweight.

FIG. 2 schematically shows a duo-mobile elevator installation 100*a* with an elevator shaft 1*a* which is formed from a shaft base 14*a* with buffers 25*a*, lateral side walls 18*c* and 18*d* and a shaft ceiling 13*a*. An upper elevator car 2*a* and a lower elevator car 2*b* are arranged one above the other in the elevator shaft 1*a*. With respect to their arrangement and suspension the two individual systems forming the duo-mobile system are identical with the arrangement and suspension, i.e. 2:1 suspensions are realized for the elevator cars 2*a* and 2*b* and 1:1 suspensions realized for the counterweights 4*a* and 4*b*. The upper elevator car 2*a* is supported in a support loop 16*c* which the supporting and driving means 3*a* forms from the drive pulley 5*a* to a fastening point 15*c* at the shaft ceiling 13*a*. In this regard the supporting and driving means 3*a* loops under the elevator car 2*a* in support rollers 17*d* and 17*e*. The elevator car 2*a* runs along guide rails 7*e* and 7*f* which are arranged along the overall height H of the elevator shaft 1*a*.

The upper elevator car 2*a* serves an uppermost floor door 8*a*, a second-uppermost floor door 9*a* and further floor doors 10*a* and 10*b*, wherein this illustration is symbolic to the extent that there can also be more or also less than only four floor doors. The same applies to the lower elevator car 2*b*, which travels to symbolically illustrated floor doors 10*c*, 10*d*, 10*e*, 10*f* and a lowermost floor door 11*a*. The lower elevator car 2*b* also runs along the guide rails 7*e* and 7*f* and is hung by support rollers 17*f* and 17*g* in a support loop 16*d*, which a supporting and driving means 3*b* forms from a first fastening point 15*d* to the drive pulley 5*b*.

The fastening point 15*d* for the lower individual system is arranged at approximately half the height of the elevator shaft 1*a*.

The two drive units 6*a* and 6*b* with the drive pulleys 5*a* and 5*b*, respectively, are arranged at the top in a shaft head 12 and allow movability of the counterweights 4*a* and 4*b* over a respective shaft height $h_1$ or $h_2$, which respectively correspond with the total height H of the elevator shaft 1*a* less the height of the shaft head 12 and less the height of a shaft pit 35.

The counterweights 4*a* and 4*b* are fastened directly to an end of the respective supporting and driving means 3*a* or 3*b* and run on guide rails 7*d* or 7*g* which extend over the entire length of the elevator shaft 1*a*.

Abutments 21*a* and 21*b* are mounted at the guide rails 7*d* and 7*g* for the counterweights 4*a* and 4*b*. They can alternatively also stand on the shaft base 14*a* and be formed similarly to the buffers 25*a*.

An exemplifying embodiment of a counterweight 4*c* is illustrated schematically in FIG. 3. It runs on the guide rail 7*d* which is fastened to the shaft wall 18*c*. The counterweight 4*c* is supported by the supporting and driving means 3 and consists of a hollow body 34 which defines a cavity 23 and integrated guide elements 19*a* and 19*b*. A counterweight of an elevator installation usually runs not on merely one guide rail, but on two guide rails 7, but the second would not be visible in the illustrated side view. The second guide rail can be enclosed by a third and a fourth integrated guide element 19.

The cavity 23 is filled with a filling 20, for example with sand. The hollow body 34 is so designed or constructed that on impact on the abutment 21*a* it bursts and the sand escapes.

Figure 4:
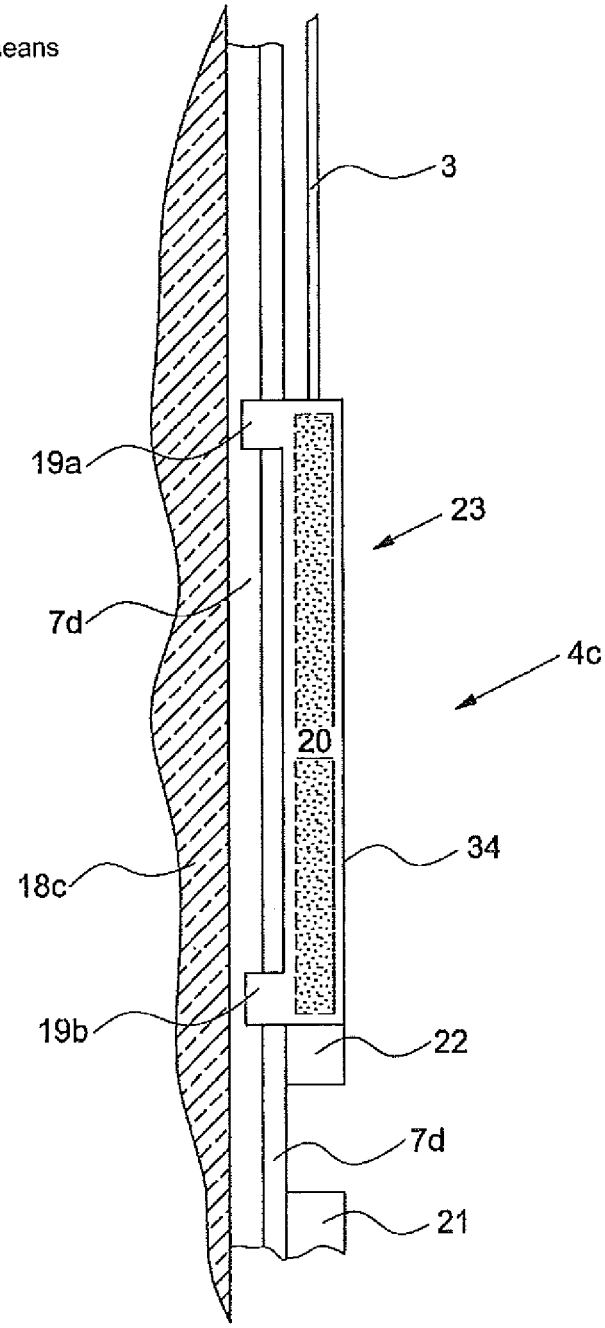
FIG. 4 shows an alternative variant of embodiment of a counterweight.

A counterweight 4*c* which is, in principle, identical is illustrated in FIG. 4, but at its underside carries an explosive charge 22. Ignition of the explosive charge 22 can be effected in principle by an abutment 21 or, however, also by means of a ripcord or by means of detection of the speed of the counterweight 4*c*.

Figure 5:
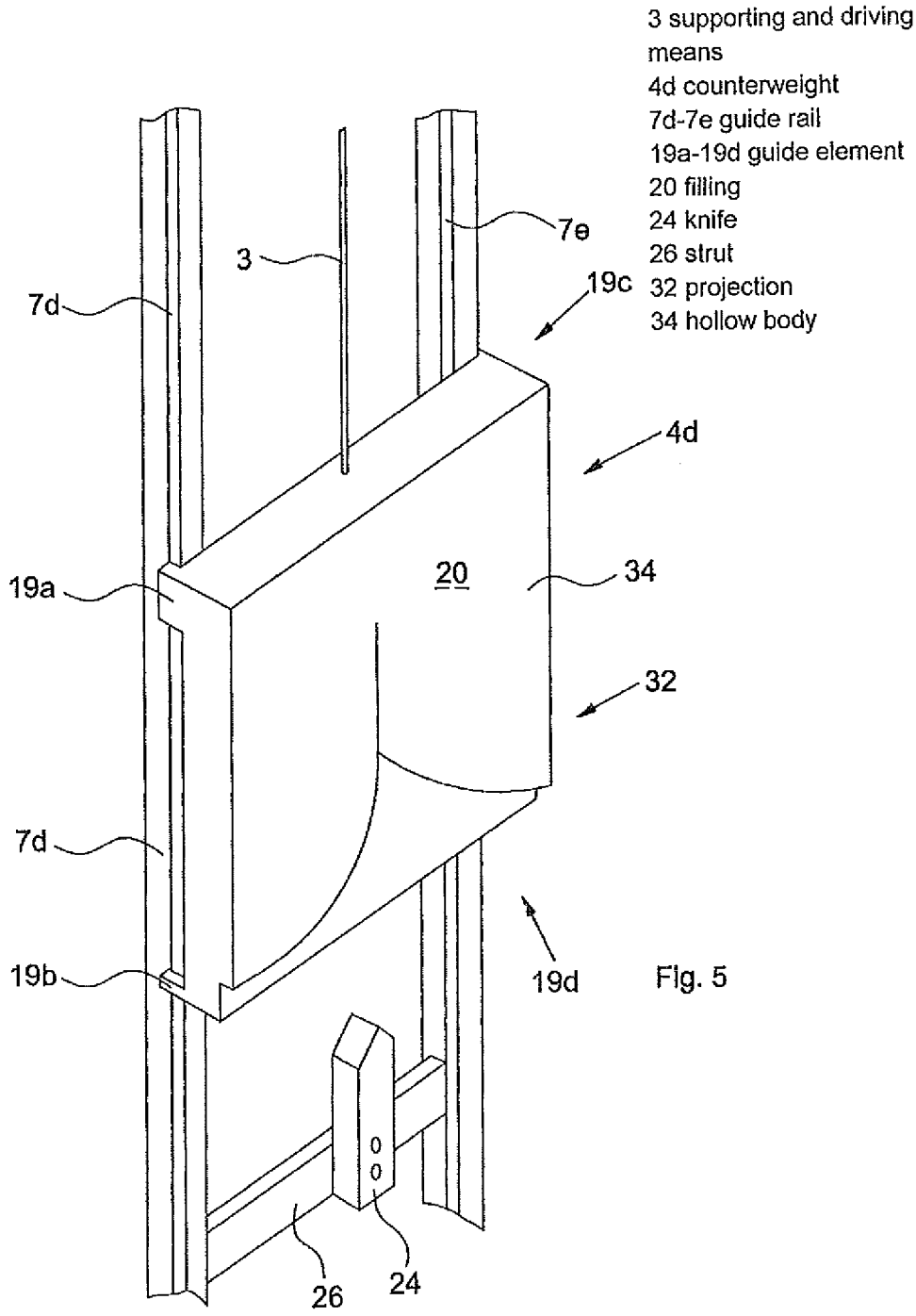
FIG. 5 shows a further variant of embodiment of a counterweight.

FIG. 5 schematically shows an exemplifying variant of embodiment of a counterweight 4*d*, which comprises a hollow body 34 with a projection 32. Fastened on a strut 26 is a knife 24 which moves into the projection 32 and thus slits open the hollow body 34. The hollow body 34 thereby empties its filling 20 when the counterweight 4*d* hits the abutment formed by the strut 26.

It is evident in this FIG. 5 thanks to a perspective illustration that the counterweight 4*d* runs by two guide elements 19*c* and 19*d* along a guide rail 7*e* arranged parallel to the guide rail 7*d*.

Figure 6:
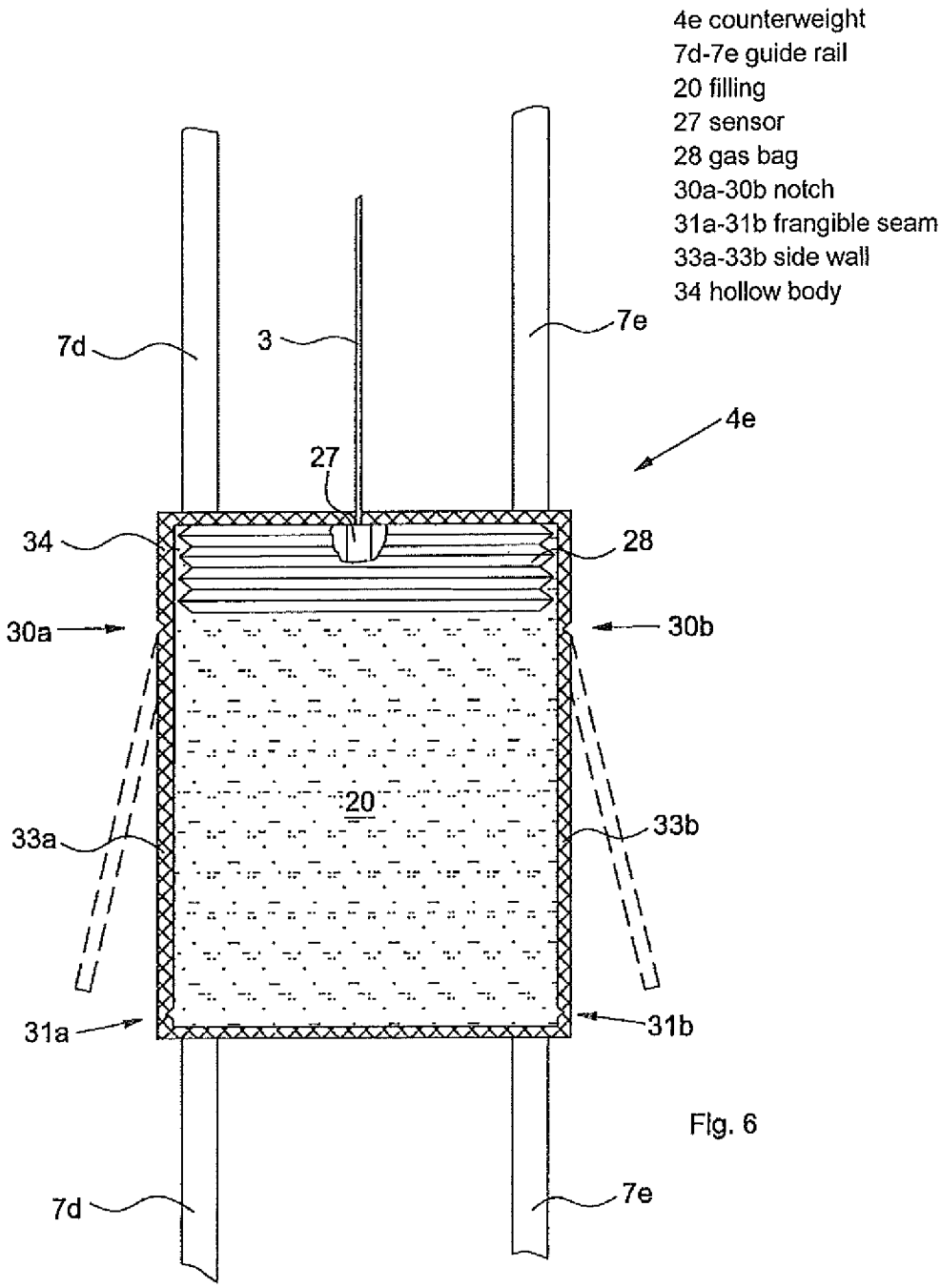
FIG. 6 shows a further variant of embodiment of a counterweight.

A further variant of embodiment of a counterweight 4*e* is illustrated in FIG. 6, which counterweight runs along the guide rails 7*d* and 7*e*. The counterweight 4*e* hangs at supporting and driving means 3 and if this should break a sensor 27 detects the absence of tensile stress and thereby triggers, for example, a pyrotechnical capsule, which is not illustrated in more detail and which brings a gas bag 28 to an expansion similar to an explosion, which in turn allows side walls 33*a* and 33*b* of the hollow body 34 to break open at frangible seams 31*a* and 31*b*. The filling 20, which in this case is preferably a liquid, can thus escape, although the hollow body 34 together with the filling 20 is disposed in freefall.

The side walls 33*a* and 33*b* are preferably provided with a notch 30*a* or 30*b*, respectively, so that the side walls 33*a* and 33*b* can more easily open. The frangible notches 31*a* and 31*b* weaken the material of the side walls 33*a* and 33*b* so that the internal pressure of the gas bag 28 or the suddenly increased internal pressure of the filling 20 lets the side walls 33*a* and 33*b* tear at these points. The notches 30*a* and 30*b*, thereagainst, weaken the material less and, in particular, only so that they still withstand the internal pressure, but nevertheless represent an intended bending point.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation having at least a first elevator car and a first counterweight, wherein the first elevator car is movable in an elevator shaft along guide rails by a drive with a drive pulley and by a supporting and driving apparatus, comprising:

the first counterweight including a hollow body formed of a synthetic material with a filling material contained by the hollow body, wherein the filling material has a relative density equal to or greater than one; and an abutment positioned in the elevator shaft whereby the first counterweight impinges on the abutment at a predetermined region of a travel path of the first counterweight to open the hollow body and release the filling material.

2. The elevator installation according to claim 1 wherein the hollow body is a one-piece body.

3. The elevator installation according to claim 1 wherein the hollow body is formed by an extruded synthetic material.

4. The elevator according to claim 1 wherein the hollow body has integrated guide elements.

5. The elevator installation according to claim 1 wherein the region is an end of the travel path at a shaft pit of the elevator shaft.

6. The elevator installation according to claim 1 wherein the elevator installation includes at least a second elevator car with a second counterweight, another drive with another drive pulley, and another supporting and driving apparatus, wherein the first and second elevator cars arranged one above the other and are movable in the elevator shaft along the guide rails, the second counterweight including a hollow body containing an additional amount of the filling material.

7. The elevator installation according to claim 6 wherein the first and second counterweights are movable over an operating height corresponding with a total height of the elevator shaft less a height of a shaft head and less a height of a shaft pit of the elevator shaft.

8. An elevator installation having at least a first elevator car and a first counterweight, wherein the first elevator car is movable in an elevator shaft along guide rails by a drive with a drive pulley and by a supporting and driving apparatus, comprising:

the first counterweight including a hollow body formed of a synthetic material with a filling material contained by the hollow body, wherein the filling material has a relative density equal to or greater than one and wherein the first counterweight includes an explosive charge for opening the hollow body of the first counterweight and releasing the filling material.

9. The elevator installation according to claim 8 wherein the explosive charge is an explosive belt surrounding the first counterweight.

10. An elevator installation having at least a first elevator car and a first counterweight, wherein the first elevator car is movable in an elevator shaft along guide rails by a drive with a drive pulley and by a supporting and driving apparatus, comprising:

the first counterweight including a hollow body formed of a synthetic material with a filling material contained by the hollow body, wherein the filling material has a relative density equal to or greater than one and wherein the first counterweight includes a projection which can be slit by a fixedly arranged knife in the elevator shaft when the first counterweight moves past on the guide rails.

11. An elevator installation having at least a first elevator car and a first counterweight, wherein the first elevator car is movable in an elevator shaft along guide rails by a drive with a drive pulley and by a supporting and driving apparatus, comprising:

the first counterweight including a hollow body formed of a synthetic material with a filling material contained by the hollow body, wherein the filling material has a relative density equal to or greater than one and wherein the supporting and driving apparatus has a sensor which monitors a tensile stress in the supporting and driving apparatus and is responsive to a signal to trigger a gas bag or an explosive charge arranged at the first counterweight.

12. The elevator installation according to claim 11 wherein the gas bag generates an internal pressure in the hollow body and tears open side walls of the hollow body at frangible notches.

13. The elevator installation according to claim 12 wherein bending notches are arranged at the side walls of the hollow body.

14. A method of dissipating kinetic energy of a counterweight having a hollow body containing a filling material and moving in an elevator installation, comprising the following steps:

monitoring a supporting and driving apparatus connected to the counterweight;

detecting an occurrence of an impermissible operating stage of the supporting and driving apparatus; and opening the hollow body of the counterweight to release the filling material in response to the detection of the impermissible operating state.

15. The method according to claim 14 wherein the impermissible operating state is one of a tensile stress on the supporting and driving apparatus is lost and the counterweight has passed a lowermost permissible position on a travel path of the counterweight.

* * * * *